US009228587B2

(12) United States Patent
Lee et al.

(10) Patent No.: US 9,228,587 B2
(45) Date of Patent: Jan. 5, 2016

(54) SCROLL COMPRESSOR FOR ACCOMMODATING THERMAL EXPANSION OF DUST SEAL

(71) Applicant: YUJIN MACHINERY LTD., Ansan-si (KR)

(72) Inventors: Jae Young Lee, Seoul (KR); Ha-Eon Sung, Gwangmyeong-si (KR)

(73) Assignee: YUJIN MACHINERY LTD., Ansan-si, Gyeonggi-do (KR)

( * ) Notice: Subject to any disclaimer, the term of this patent is extended or adjusted under 35 U.S.C. 154(b) by 35 days.

(21) Appl. No.: 14/181,798

(22) Filed: Feb. 17, 2014

(65) Prior Publication Data

US 2014/0234149 A1 Aug. 21, 2014

(30) Foreign Application Priority Data

Feb. 17, 2013 (CN) ..... 2013 1 0051758
Jan. 14, 2014 (KR) ..... 10-2014-0004542

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 27/00*** | (2006.01) |
| ***F04C 18/02*** | (2006.01) |
| ***F04C 23/00*** | (2006.01) |

(52) U.S. Cl.

CPC ..... *F04C 27/003* (2013.01); *F04C 18/0215* (2013.01); *F04C 23/008* (2013.01); *F04C 27/005* (2013.01); *F05C 2251/042* (2013.01)

(58) Field of Classification Search

CPC .. F04C 18/0215; F04C 27/001; F04C 27/003; F04C 27/005; F04C 23/008; F01C 1/0215; F05C 2251/042

USPC ..... 418/55.1–55.6, 57, 142, 104, 102; 464/102; 277/352, 564, 573, 577

See application file for complete search history.

(56) References Cited

U.S. PATENT DOCUMENTS

| | | | | |
|---|---|---|---|---|
| 6,659,743 | B2 * | 12/2003 | Kimura et al. | 418/55.2 |
| 6,695,597 | B2 | 2/2004 | Kimura et al. | |
| 7,044,722 | B2 * | 5/2006 | Fujioka et al. | 418/55.3 |
| 7,195,469 | B2 * | 3/2007 | Tsuchiya et al. | 418/55.4 |
| 7,234,923 | B2 * | 6/2007 | Sato | 418/55.4 |
| 8,186,980 | B2 * | 5/2012 | Komai et al. | 418/55.3 |
| 2007/0224072 | A1 * | 9/2007 | Ishikawa et al. | 418/55.4 |
| 2012/0009077 | A1 * | 1/2012 | Iwano et al. | 418/55.6 |

FOREIGN PATENT DOCUMENTS

| | | | | |
|---|---|---|---|---|
| JP | 6-213174 A | * | 8/1994 | 418/55.3 |
| KR | 2006-0045343 | | 5/2006 | |
| KR | 2007-0049556 | | 5/2007 | |

* cited by examiner

*Primary Examiner* — Theresa Trieu
(74) *Attorney, Agent, or Firm* — Sand & Sebolt

(57) ABSTRACT

The present invention provides a scroll compressor which includes a housing, a stationary scroll including a stationary wrap, an orbiting scroll having an orbiting wrap, a receiving portion formed in the housing, a self-rotation preventing eccentric shaft installed in the receiving portion with a bearing interposed therebetween, a self-rotation preventing mechanism including a stopper formed in the housing to support the front of the bearing, and a bearing tube fixed to the housing to support a drive shaft, the scroll compressor including: an annular groove formed in the stationary scroll or in the orbiting scroll; a dust seal fitted in the annular groove and having first and second ends at both ends; and a stationary block including a first support member and first and second elastic members which extend from the first support member and face the first and second ends, the stationary block being fitted in the annular groove.

25 Claims, 7 Drawing Sheets

SCROLL COMPRESSOR FOR ACCOMMODATING THERMAL EXPANSION OF DUST SEAL

CROSS-REFERENCE TO RELATED PATENT APPLICATION

This application claims the benefits of Chinese Patent Application No. 201310051758.3, filed on Feb. 17, 2013 and Korean Patent Application No. 10-2014-004542, filed on Jan. 14, 2014, the disclosures of which are incorporated herein in its entirety by reference.

BACKGROUND OF THE INVENTION

1. Field of the Invention

The present invention relates to a scroll compressor and, more particularly, to a scroll compressor which can prevent damage due to expansion of a dust seal with an increase in temperature and, at the same time, reduce noise by absorbing vibration of a self-rotation preventing mechanism.

2. Description of the Related Art

In general, a scroll compressor comprises an orbiting scroll supported on an eccentric shaft portion of a drive shaft and a stationary scroll including a stationary end plate having a stationary wrap.

An orbiting wrap on an orbiting end plate of the orbiting scroll is engaged with the stationary wrap to form a sealed chamber between the stationary wrap and the orbiting wrap.

Moreover, the scroll compressor comprises a self-rotation preventing device for preventing the orbiting scroll from rotating on its own axis.

By the eccentric shaft portion of the drive shaft and the self-rotation preventing device, the orbiting scroll is eccentrically revolved such that the volume in the sealed chamber gradually decreases toward the center to be compressed or gradually increases away from the center to be depressurized to discharge from the outer circumference.

Meanwhile, the ends of the orbiting and stationary wraps have engagement grooves in which tip seals being in sliding contact with the opposing end plates are fitted sealingly, and the tip seals are fitted in the engagement grooves.

Moreover, in the scroll compressor, a dust seal on the outer circumference of an engagement area of the orbiting and stationary wraps.

A representative example of this scroll compressor is disclosed in patent document 1 (hereinafter referred to as "prior art 1").

However, the dust seal and the tip seals of the scroll compressor prior art 1 have the following problems:

(a) Circle

The circular dust seal fitted in an annular groove requires very precise dimensions and significant efforts and techniques. Moreover, heat or lateral pressure generated during operation stretches the dust seal or deforms the annular groove to cause unsuitable fitting. Deviation of the dust seal in the annular groove causes failure in sealing;

(b) Partially Separated Circle Whose Ends are in Contact with or Close to Each Other To absorb thermal expansion of the dust seal, a slight gap is formed between the ends in advance. However, it is impossible to completely prevent dust from entering through the gap. To prevent this, the ends of the dust seal are tilted or overlapped: which is cumbersome and expensive. The dust seal tends to move in the annular groove toward the periphery;

(c) Partially Separated Circle Whose Ends are in Contact with the Outer Surface of the Outermost Tip Seal The annular groove must be formed into a non-circular shape, which is not so easy to achieve. During operation, a gap is formed between the end of the dust seal and the outer surface of the tip seal, and thus dust enters through the gap; and (d) When the Tip Seals are Worn Due to Sliding Contact, the Sealability is Reduced.

Moreover, the scroll compressor comprises a self-rotation preventing mechanism for preventing the orbiting scroll from rotating on its own axis.

Furthermore, by the eccentric shaft portion of the drive shaft and the self-rotation preventing device, the orbiting scroll is eccentrically revolved such that the volume in the sealed chamber gradually decreases toward the center to be compressed or gradually increases away from the center to be depressurized to discharge from the outer circumference.

A representative example of this scroll compressor is disclosed in patent document 2 (hereinafter referred to as "prior art 2").

However, the scroll compressor of prior art 2 does not disclose a means for reducing vibration generated by the revolution of a self-rotation preventing eccentric shaft of the self-rotation preventing mechanism.

Therefore, the noise due to the vibration increases, and the durability of the scroll compressor is reduced.

Moreover, in the scroll compressor of prior art 2, a bearing tube for supporting a bearing installed in the drive shaft is integrally formed with a housing.

Therefore, when the housing is made of aluminum alloy, the bearing tube is thermally expanded during operation of the scroll compressor, which reduces the force for supporting a ball bearing, causing the ball bearing to rotate in the bearing tube.

When the housing is made of cast iron to prevent the rotation of the ball bearing in the bearing tube, the force for supporting the ball bearing is sufficient, but the total weight of the scroll compressor increases, which is problematic.

To solve the above problem, a scroll compressor in which the housing is made of aluminum alloy and the bearing tube is made of cast iron is disclosed in patent document 3 (hereinafter referred to as "prior art 3").

However, in the scroll compressor of prior art 3, the bearing tube supporting the drive shaft is detachably assembled to the housing and is fixed to the housing with a bolt, and thus the number of assembling processes increases, which is problematic.

Moreover, the number of total processes such as processing for the bolt connection area between the housing and the bearing tube, etc. increases, and thus the manufacturing cost of the scroll compressor increases.

Therefore, there is a need to develop a scroll compressor which solves the problem due to the thermal expansion of the dust seal, increases the sealing force of the tip seals, reduces the noise due to the vibration of the self-rotation preventing mechanism, and solves the problem due to the thermal expansion of the bearing tube.

Patent document 1: U.S. Pat. No. 6,695,597 (Anest Iwata Corporation) 2004.02.24

Patent document 2: Korean Patent Publication No. 2007-0049556 (2007.05.11)

Patent document 3: Korean Patent Publication No. 2006-0045343 (2006.05.17)

SUMMARY OF THE INVENTION

The present invention has been made in an effort to solve the above-described problems associated with prior art, and an object of the present invention is to provide a scroll compressor which accommodates thermal expansion of a dust seal to improve the durability of the dust seal.

Another object of the present invention is to provide a scroll compressor which allows the pressure of a sealed chamber to act on a tip seal to increases the sealability of the sealed chamber.

Still another object of the present invention is to provide a scroll compressor which damps vibration of a self-rotation preventing mechanism to absorb the vibration, thus reducing noise.

Yet another object of the present invention is to provide a scroll compressor in which a bearing tube is made of a material different from that of a housing to reduce the effect of thermal expansion.

Still yet another object of the present invention is to provide a scroll compressor in which a bearing tube is integrally formed with a housing during aluminum die casting.

To achieve the above objects, the present invention provides a scroll compressor which comprises a housing, a stationary scroll including a stationary wrap, an orbiting scroll having an orbiting wrap, a receiving portion formed in the housing, a self-rotation preventing eccentric shaft installed in the receiving portion with a bearing interposed therebetween, a self-rotation preventing mechanism including a stopper formed in the housing to support the front of the bearing, and a bearing tube fixed to the housing to support a drive shaft, the scroll compressor comprising: an annular groove formed in the stationary scroll or in the orbiting scroll; a dust seal fitted in the annular groove and having first and second ends at both ends; and a stationary block including a first support member and first and second elastic members which extend from the first support member and face the first and second ends, the stationary block being fitted in the annular groove.

An opening may be formed between the first and second elastic members.

The first and the second ends may have lengths that are in close contact with or spaced from the first and second elastic members.

Second support members may extend from the first and second elastic members and may be bent respectively, and receiving grooves, in which the first and second ends are fitted respectively, may be formed between the first and second support members.

When the dust seal is thermally expanded, the first and second ends may press the first and second elastic members by the expanded length of the dust seal.

Seal grooves may be formed in areas where the stationary wrap and the orbiting wrap face each other, and tip seals may be fitted in the seal grooves.

Inflow grooves may be formed on one side of the tip seals, and spacing members may be formed in areas facing the bottom of the seal grooves of the tip seals.

The inflow grooves and the spacing members may be formed continuously at regular intervals in the longitudinal direction of the tip seals.

The spacing members may be cut at an acute angle on the bottom surface of the tip seals.

The inflow grooves may be formed in a direction facing a sealed chamber formed by the stationary wrap and the orbiting wrap.

A first damping groove may be formed on an inner circumferential surface of the receiving portion, and a second damping groove may be formed on the front surface of the stopper.

The first damping groove may be spaced from the rear wall of the stopper in front of the receiving portion.

The second damping groove may have an arc or semicircular cross section, and the center of the arc or semicircular second damping groove may not exceed the height of the first damping groove.

A third damping groove may be formed between the stopper and the second damping groove.

The third damping groove may have an arc or semicircular cross section, and the center of the arc or semicircular third damping groove may not exceed the height of the receiving portion.

The third damping groove may have a cross sectional area smaller than that of the second damping groove.

A line connecting the centers of the cross sections of the stopper, the third damping groove, the second damping groove, and the first damping groove may have a stepped shape.

The second damping groove and the third damping groove may have a circular or arc shape.

A round shape may be formed between the second damping groove and the third damping groove.

The bearing tube may be made of cast iron, and the housing may be made of aluminum, the housing being integrally formed with the bearing tube by aluminum die casting.

An axial locking projection may be formed on the outer circumferential surface of the bearing tube.

A first rotation preventing groove may be formed in the axial locking projection.

A second rotation preventing groove may be formed in the bearing tube.

First and second stepped portions may be formed on both sides of the receiving portion, and the first and second stepped portions may have an inner diameter greater than that of the inner circumferential surface of the receiving portion.

The first stepped portion may be formed on both sides of the first damping groove.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Hereinafter, preferred embodiments of the present invention will be described in detail with reference to the accompanying drawings.

Figure 1:
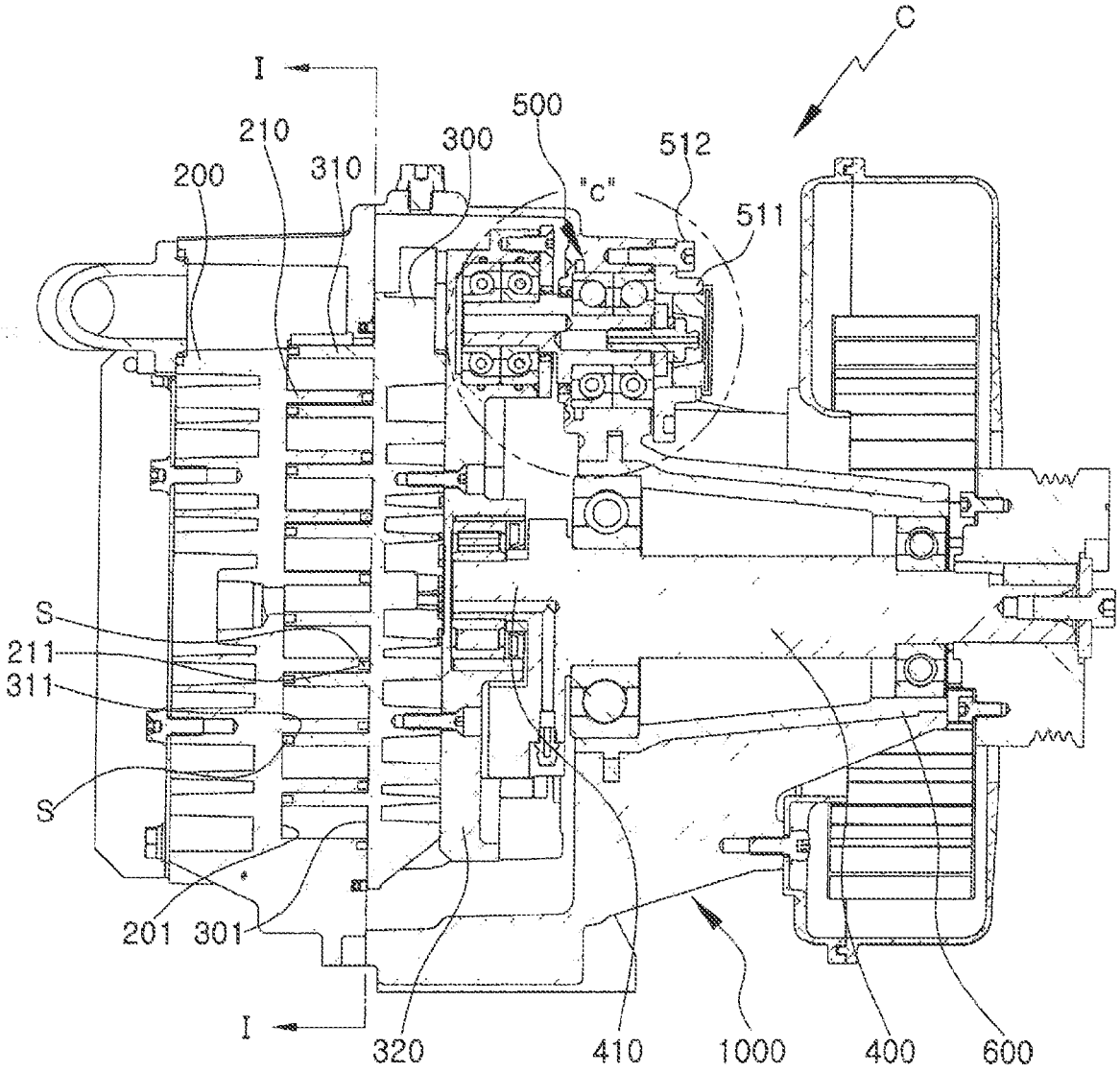
FIG. 1 is a cross-sectional view showing a scroll compressor according to the present invention.
Figure 2:
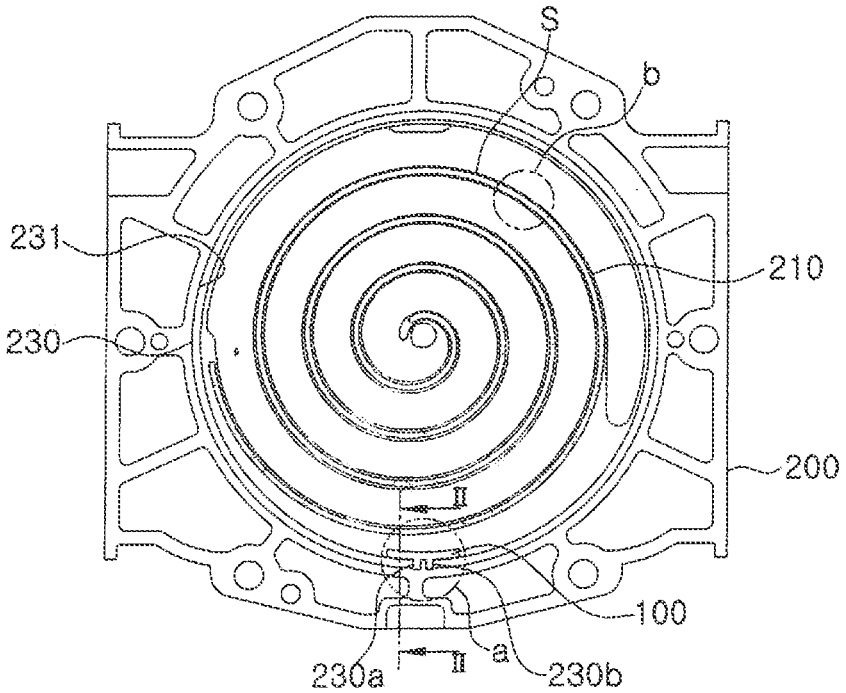
FIG. 2 is a front view taken along line I-I of FIG. 1, showing the area to which a stationary block in accordance with a first embodiment of the present invention is applied.
Figure 3:
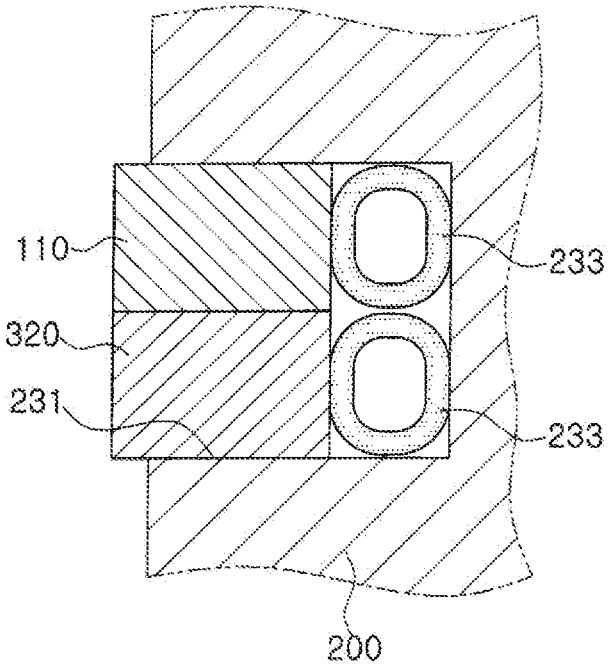
FIG. 3 is an enlarged cross-sectional view taken along line II-II of FIG. 2.
Figure 4A:
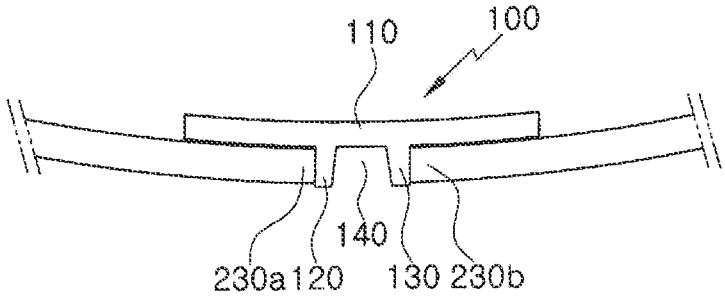
FIGS. 4A and 4B are enlarged views of portion "a" of FIG. 2.
Figure 4B:
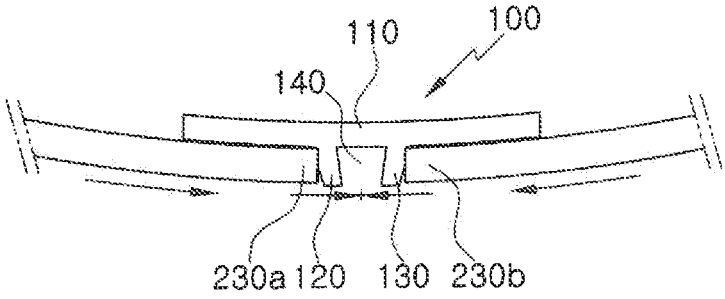
Figure 5A:
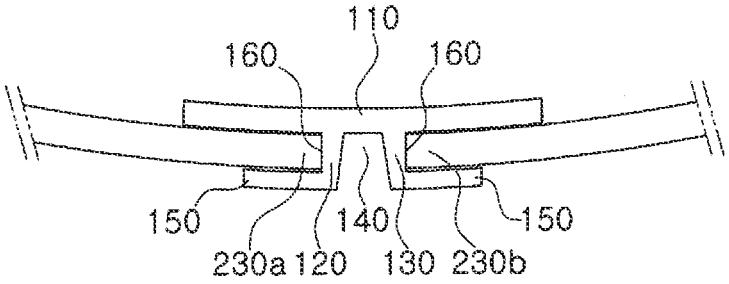
FIGS. 5A and 5B are enlarged views showing a stationary block in accordance with a second embodiment of the present invention.
Figure 5B:
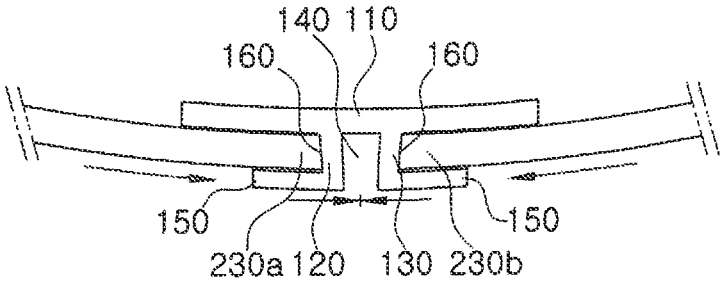
Figure 6:
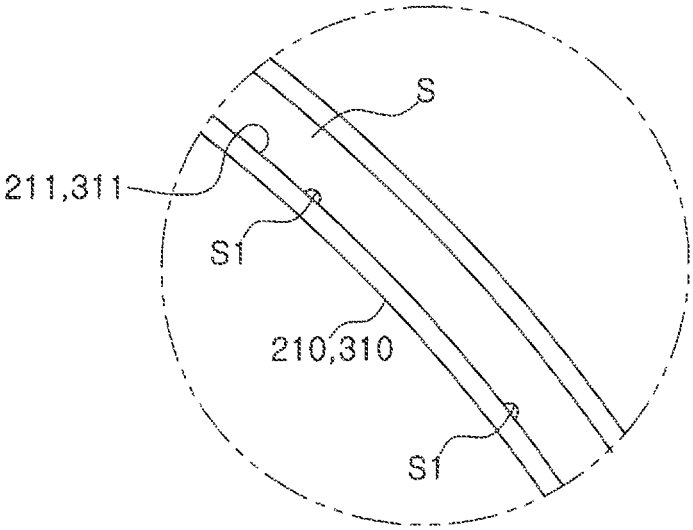
FIG. 6 is an enlarged view of portion "b" of FIG. 2.
Figure 7:
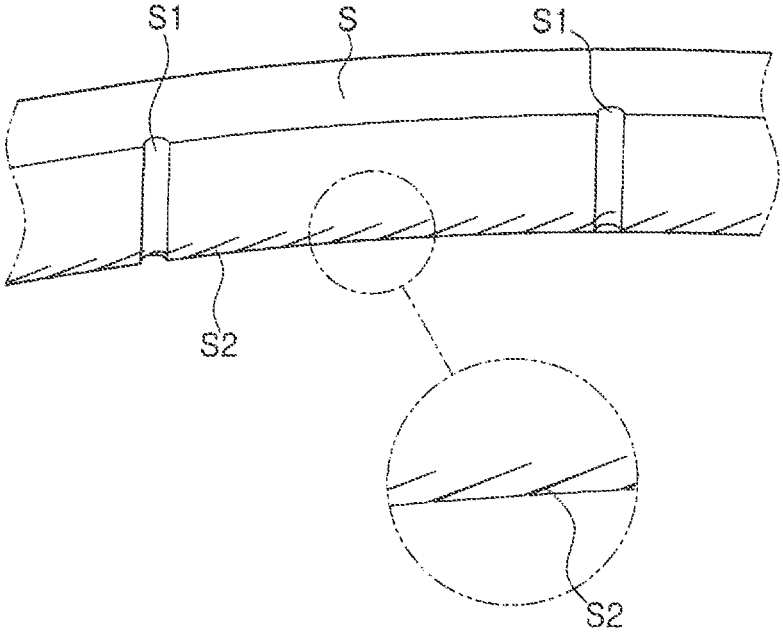
FIG. 7 is a perspective view showing a tip seal of FIG. 6.
Figure 8:
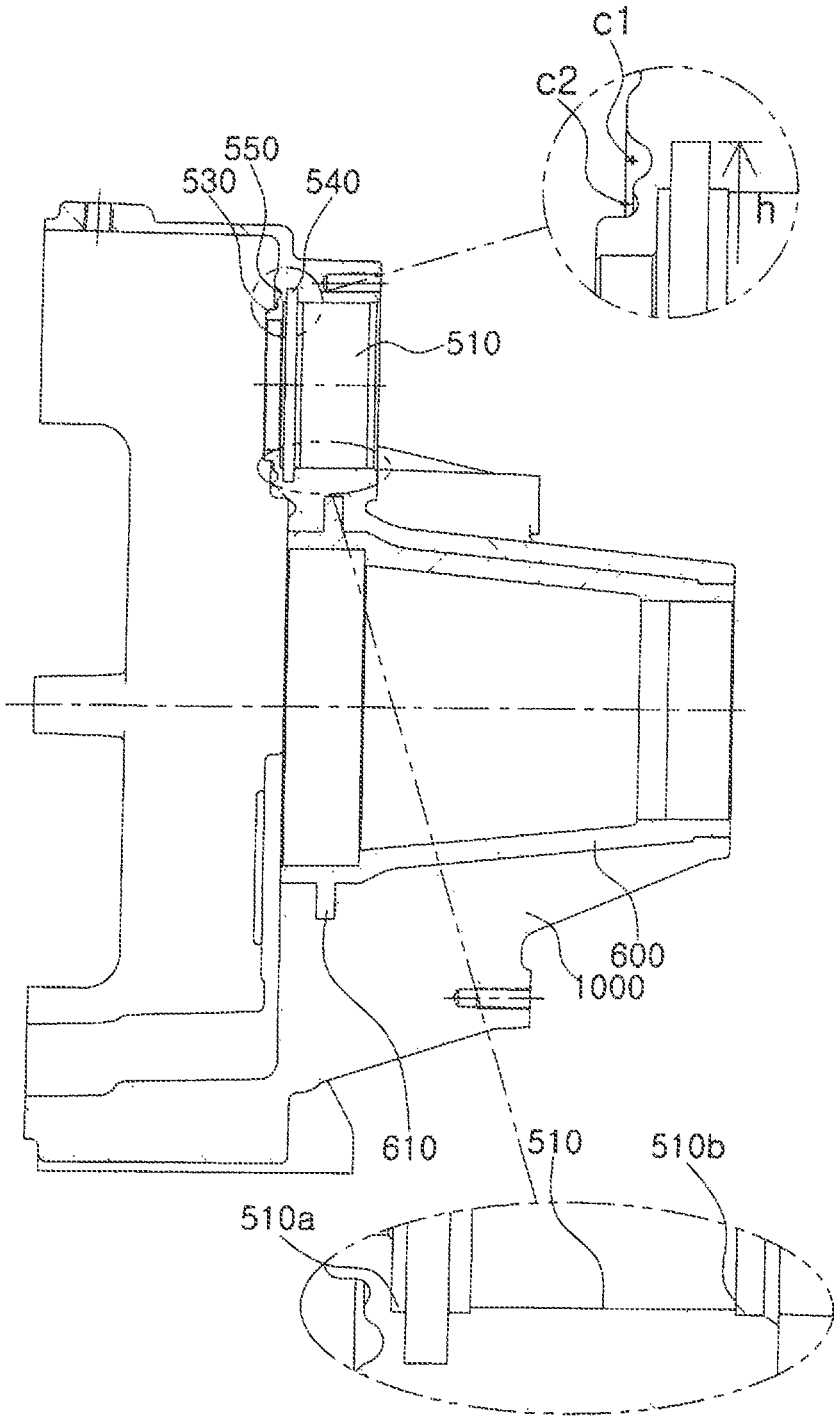
FIG. 8 is a cross-sectional view showing a housing of FIG. 1.
Figure 9:
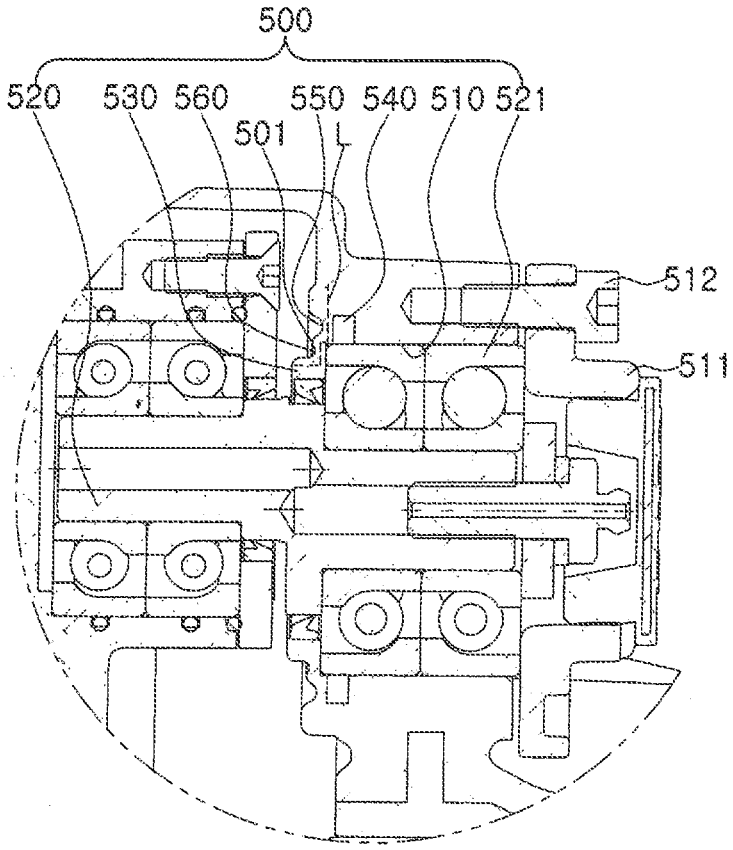
FIG. 9 is an enlarged view of portion "c" of FIG. 1.
Figure 10:
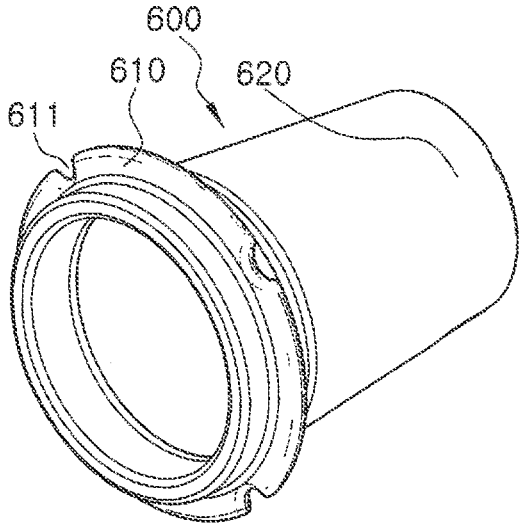
FIG. 10 is a perspective view showing a bearing tube of FIG. 8.

FIG. 1 is a cross-sectional view showing a scroll compressor according to the present invention, FIG. 2 is a front view taken along line of FIG. 1, showing the area to which a stationary block in accordance with a first embodiment of the present invention is applied, FIG. 3 is an enlarged cross-sectional view taken along line II-II of FIG. 2, FIGS. 4A and 4B are enlarged views of portion "a" of FIG. 2, FIGS. 5A and 5B are enlarged views showing a stationary block in accordance with a second embodiment of the present invention, FIG. 6 is an enlarged view of portion "b" of FIG. 2, FIG. 7 is a perspective view showing a tip seal of FIG. 6, FIG. 8 is a cross-sectional view showing a housing of FIG. 1, FIG. 9 is an enlarged view of portion "c" of FIG. 1, and FIG. 10 is a perspective view showing a bearing tube of FIG. 8.

In FIG. 1, the left is the front and the right is the rear.

As shown in FIGS. 1 to 10, a scroll compressor C according to the present invention comprises a housing 1000, a stationary scroll 200 which closes an open front end of the housing 1000 and includes a spiral stationary wrap 210, an orbiting scroll 300 which includes a spiral orbiting wrap 310 formed in an area facing the stationary scroll 200, and a drive shaft 400 which includes an orbiting shaft portion 410 installed with the orbiting scroll 300 and a bearing interposed therebetween and is provided in the housing 1000.

First, a space in which the above-described components of the housing 1000 are mounted is provided.

Moreover, the orbiting wrap 310 of the orbiting scroll 300 is engaged with the stationary wrap 210 of the stationary scroll 200, and thus a sealed chamber is formed between the stationary wrap 210 and the orbiting wrap 310.

A bearing plate 320 is disposed on the rear of the orbiting scroll 300.

Meanwhile, seal grooves 211 and 311, in which tip seals S being in sliding contact with a stationary end plate 201 of the stationary scroll 200 and an orbiting end plate 301 of the orbiting scroll 300 to increase the sealability are fitted, are formed on the ends of the stationary wrap 210 and the orbiting wrap 310.

Moreover, as shown in FIG. 2, an annular groove 231 is formed on the circumference of the stationary scroll 200 to surround the stationary warp 210, and the annular groove 231 has substantially the same width. Meanwhile, the annular groove 231 may be formed on the orbiting scroll 300.

A dust seal 230 for preventing dust from entering the sealed chamber formed between the stationary wrap 210 and the orbiting wrap 310 is fitted in the annular groove 231.

Moreover, as shown in FIG. 3, it is of course that an elastic tube 233 for applying an elastic force to the dust seal 230 is fitted in the bottom of the annular groove 231.

Meanwhile, a first end 230*a* and a second end 230*b* are formed on both ends of the dust seal 230 and have lengths that are in contact with or close to first and second elastic members 120 and 130 which will be described later.

Moreover, a stationary block 100 which is fitted in the annular groove 231 to fix the first and second ends 230*a* and 230*b* of the dust seal 230 is further provided.

Furthermore, a crank-pin-type self-rotation preventing mechanism 500 is provided in the orbiting scroll 300 such that the orbiting scroll 300 eccentrically revolves around the drive shaft 400 with respect to the stationary scroll 200 fixed to the housing 1000 in which the orbiting scroll 300 is accommodated.

Meanwhile, a bearing tube 600 is interposed between the housing 1000 and the drive shaft 400, and a bearing is provided between the bearing tube 600 and the drive shaft 400.

For other structures, various configurations of known conventional scroll compressors may be employed, and thus a detailed description thereof will be omitted.

In the following, the stationary block 100 and the tip seals S of the preset invention will be described.

First, the stationary block 100 comprises a first support member 110 and first and second elastic members 120 and 130 which extend downward from the first support member 110 and face the first and second ends 230*a* and 230*b*, respectively.

Moreover, an opening 140 is formed between the first and second elastic members 120 and 130.

Meanwhile, the first and second ends 230*a* and 230*b* of the dust seal 230 have lengths that are in close contact with or spaced from the first and second elastic members 120 and 130 in the absence of thermal expansion of the dust seal 230.

Here, when the dust seal 230 is thermally expanded by operation of the scroll compressor as the first and second ends 230*a* and 230*b* are in close contact with the first and second elastic members 120 and 130, the first and second ends 230*a* and 230*b* elastically deform the first and second elastic members 120 and 130, thus accommodating the thermal expansion of the dust seal 230 as shown in FIG. 4. Therefore, the deformation of the dust seal 230 is prevented, resulting in an increase in the durability of the dust seal 230.

In this case, the dust seal 230 and the stationary block 100 are also in close contact with each other, thus preventing the entrance of dust.

Moreover, when the dust seal 230 is thermally expanded by operation of the scroll compressor as the first and second ends 230*a* and 230*b* have lengths that are spaced from the first and second elastic members 120 and 130, the first and second ends 230*a* and 230*b* are in close contact with the first and second elastic members 120 and 130, thus accommodating the thermal expansion of the dust seal 230 as shown in FIG. 4. Therefore, the deformation of the dust seal 230 is prevented, resulting in an increase in the durability of the dust seal 230.

Even in this case, the dust seal 230 and the stationary block 100 are also in close contact with each other, thus preventing the entrance of dust.

As shown in FIGS. 5A and 5B, second support members 150 extends from the first and second elastic members 120 and 130 and are bent respectively, and receiving grooves 160, in which the first and second ends 230*a* and 230*b* are fitted respectively, are formed between the first and second support members 110 and 150.

As a result, the first and second ends 230*a* and 230*b* of the dust seal 230 are fitted in the receiving grooves 160, thus preventing the entrance of dust. Moreover, the deformation of the dust seal 230 due to the expansion is accommodated as shown in FIG. 5B.

That is, when the dust seal 230 is thermally expanded, the first and second ends 230*a* and 230*b* press the first and second elastic members 120 and 130 by the expanded length of the dust seal 230, thus preventing the deformation of the dust seal 230.

Moreover, inflow grooves S1 are formed on the tip seals S fitted in the seal grooves 211 and 311 formed on the ends of the stationary wrap 210 and the orbiting wrap 310, and spacing members S2 are formed in areas facing the bottom of the seal grooves 211 and 311 of the tip seals S.

The inflow grooves S1 and the spacing members S2 are formed continuously at regular intervals in the longitudinal direction of the tip seals S.

Meanwhile, the spacing members S2 are cut at an acute angle on the bottom surface of the tip seals S. The spacing members S2 may be formed continuously in the form of triangular teeth.

Lastly, the inflow grooves S1 are formed in a direction facing the sealed chamber formed by the stationary wrap 210 and the orbiting wrap 310. That is, the inflow grooves S1 are formed in a direction in which the compression is substantially made such that a compressible fluid flows into the inflow grooves S1.

Therefore, the compressible fluid flows into the inflow grooves S1, and the compressible fluid flowing into the inflow grooves S1 flows between the tip seals S and the bottoms of the seal grooves 211 and 311 to lift the tip seals S, thus increasing the sealability between the stationary wrap 210 and the orbiting wrap 310. That is, the compression efficiency is also increased by the increase in the sealability.

In the following, the self-rotation preventing mechanism 500 and the bearing tube 600 of the present invention will be described.

First, as shown in FIG. 1 and FIGS. 8 to 10, the self-rotation preventing mechanism 500 provided in the housing 1000 to prevent the rotation of the orbiting scroll 300 comprises a receiving portion 510 formed in the housing 1000, a self-rotation preventing eccentric shaft 520 installed in the receiving portion 510 with a bearing 521 interposed therebetween, and a stopper 530 formed in the housing 1000 to support the front of the bearing 521.

Moreover, an open end of the receiving portion 510 is closed by a cover 511.

The stopper 530 protrudes to the front, and the self-rotation preventing eccentric shaft 520 is installed on the rear of the orbiting scroll 300.

Meanwhile, a first damping groove 540 is formed on an inner circumferential surface of the receiving portion 510, and a second damping groove 550 is formed on the front surface of the stopper 530.

Therefore, the first and second damping grooves 540 and 550 damp vertical vibration with respect to the axial direction due to the rotation of the self-rotation preventing eccentric shaft 520 to absorb the vibration, thus reducing noise.

Moreover, the first damping groove 540 is spaced from the rear wall of the stopper 530 in front of the receiving portion 510. Therefore, the first damping groove 540 attenuates the vibration generated by the stopper 530 protruding to the front.

The second damping groove 550 has an arc or semicircular cross section, and the center c1 of the arc or semicircular second damping groove 550 does not exceed the height h of the first damping groove 540.

Meanwhile, a third damping groove 560 is formed between the front surface of the stopper 530 and the second damping groove 550.

The third damping groove 560 also has an arc or semicircular cross section, and the center c2 of the arc or semicircular third damping groove 560 does not exceed the height of the receiving portion 510.

Therefore, an additional elastic deformation is added to the change in elasticity of the first and second damping grooves 540 and 550 by the third damping groove 560, and thus the vibration is damped, thus reducing noise.

The third damping groove 560 has a cross sectional area smaller than that of the second damping groove 550.

Meanwhile, when viewed from the lateral cross section, a line L connecting the centers of the cross sections of the stopper 530, the third damping groove 560, the second damping groove 550, and the first damping groove 540 has a stepped shape, and thus the connection area between the stopper 530 and the housing 1000 has a uniform thickness.

Therefore, the elastic deformation of the first to third damping grooves 540, 550, and 560 occurs uniformly to damp the vibration due to the rotation of the self-rotation preventing eccentric shaft 520, thus reducing noise.

That is, the self-rotation preventing eccentric shaft 520 and the orbiting scroll 300 can be smoothly driven by the vibration prevention.

Moreover, since the line L connecting the centers of the cross sections of the stopper 530, the third damping groove 560, the second damping groove 550, and the first damping groove 540 has a stepped shape, the connection area of the stopper 530 can be minimized, and thus the range of deformation in all directions of the area where the stopper 530 is formed is increased, which makes it possible to respond to various types of amplitudes generated in the self-rotation preventing eccentric shaft 520.

Furthermore, the assembly tolerance can be minimized during the assembly of the cover 511. Specifically, the cover 511 is assembled with a bolt 512 and, at this time, the first to third damping grooves 540, 550, and 560 are elastically deformed such that the orbiting scroll 300 is in close contact with the stationary scroll 200.

During rotation of the self-rotation preventing eccentric shaft 520, the first elastic deformation occurs in the third damping groove 560 and then the second elastic deformation occurs in the second damping groove 550. At this time, the elastic deformation of the second damping groove 550 is caused by a thin wall between the second damping groove 550 and the first damping groove 540.

Meanwhile, the second damping groove 550 and the third damping groove 560 have a circular or arc shape.

Moreover, a round shape 501 is formed between the second damping groove 550 and the third damping groove 560.

First and second stepped portions 510*a* and 510*b* are formed on both sides of the receiving portion 510, and the first and second stepped portions 510*a* and 510*b* have an inner diameter greater than that of the inner circumferential surface of the receiving portion 510.

Meanwhile, the first stepped portion 510*a* is formed on both sides of the first damping groove 540.

Therefore, the first and second stepped portions 510*a* and 510*b* are not in close contact with the outer circumference of the bearing 521, and thus the area where the stopper 530 is formed and the rear end of the receiving portion 510 are elastically deformed to absorb the vibration, thus preventing the generation of noise.

The bearing tube 600 is made of cast iron having a low coefficient of thermal expansion, and the housing 1000 is made of aluminum which has a relatively low weight, the housing 1000 being integrally formed with the bearing tube 600 by aluminum die casting.

Moreover, the bearing tube 600 is integrally formed with the housing 1000 during aluminum die casting, after casting and post-processing with a machine tool.

Therefore, the total weight of the scroll compressor is reduced due to the housing 1000 made of aluminum, and the thermal expansion is prevented by the bearing tube 600 made of cast iron, thus preventing the force for supporting the bearing from being reduced.

An axial locking projection 610 is formed on the outer circumferential surface of the bearing tube 600 to prevent the bearing tube 600 from being separated from the housing 1000 in front and rear directions.

Meanwhile, a first rotation preventing groove 611 is formed in the axial locking projection 610 to prevent the bearing tube 600 from rotating with respect to the housing 1000.

Moreover, a second rotation preventing groove 620 is formed in the bearing tube 600 to prevent the bearing tube 600 from rotating with respect to the housing 1000.

The first and second rotation preventing grooves 611 and 620 are formed plurally along the outer circumferential surface of the bearing tube 600.

The axial locking projection 610 and the first and second rotation preventing grooves 611 and 620 are covered or filled with aluminum during the die casting of the housing 1000, thus preventing the axial movement and rotation of the bearing tube 600 with respect to the housing 1000.

As described above, according to the scroll compressor of the present invention, the thermal expansion of the dust seal is accommodated by the stationary block, which increases the durability of the dust seal. That is, it is possible to prevent the entrance of foreign substances from the outside.

Moreover, the pressure of the sealed chamber is applied to the tip seals by the inflow grooves and the spacing members to increase the sealability of the sealed chamber.

Furthermore, the vibration due to the rotation of the self-rotation preventing eccentric shaft is damped by the elastic deformation of the first to third damping grooves, thus reducing noise. Therefore, the self-rotation preventing eccentric shaft and the orbiting scroll can be smoothly driven by the vibration prevention.

In addition, the assembly tolerance can be minimized during the assembly of the cover. Specifically, the cover is assembled with a bolt and, at this time, the first to third damping grooves are elastically deformed such that the orbiting scroll is in close contact with the stationary scroll.

Additionally, the bearing tube made of cast iron is integrally formed with the housing during aluminum die casting, thus reducing the thermal expansion due to the rotation of the drive shaft.

Also, the rotation of the bearing tube is prevented by the first and second rotation preventing grooves.

While the invention has been shown and described with reference to certain preferred embodiments thereof, it will be understood by those skilled in the art that various changes in form and details may be made therein without departing from the spirit and scope of the invention as defined by the appended claims. Therefore, the scope of the invention is defined not by the detailed description of the invention but by the appended claims, and all differences within the scope will be construed as being included in the present invention.

What is claimed is:

1. A scroll compressor which comprises a housing, a stationary scroll including a stationary wrap, an orbiting scroll having an orbiting wrap, a receiving portion formed in the housing, a self-rotation preventing eccentric shaft installed in the receiving portion with a bearing interposed therebetween, a self-rotation preventing mechanism including a stopper formed in the housing to support the front of the bearing, and a bearing tube fixed to the housing to support a drive shaft, the scroll compressor comprising:

an annular groove formed in the stationary scroll or in the orbiting scroll;

a dust seal fitted in the annular groove and having first and second ends at both ends; and a stationary block including a first support member and first and second elastic members which extend from the first support member and face the first and second ends, the stationary block being fitted in the annular groove.

2. The scroll compressor of claim 1, wherein an opening is formed between the first and second elastic members.

3. The scroll compressor of claim 1, wherein the first and the second ends have lengths that are in close contact with or spaced from the first and second elastic members.

4. The scroll compressor of claim 1, wherein second support members extends from the first and second elastic members and are bent respectively, and receiving grooves, in which the first and second ends are fitted respectively, are formed between the first and second support members.

5. The scroll compressor of claim 1, wherein when the dust seal is thermally expanded, the first and second ends press the first and second elastic members by the expanded length of the dust seal.

6. The scroll compressor of claim 1, wherein seal grooves are formed in areas where the stationary wrap and the orbiting wrap face each other, and tip seals are fitted in the seal grooves.

7. The scroll compressor of claim 6, wherein inflow grooves are formed on one side of the tip seals, and spacing members are formed in areas facing the bottom of the seal grooves of the tip seals.

8. The scroll compressor of claim 7, wherein the inflow grooves and the spacing members are formed continuously at regular intervals in the longitudinal direction of the tip seals.

9. The scroll compressor of claim 6, wherein the spacing members are cut at an acute angle on a bottom surface of the tip seals.

10. The scroll compressor of claim 6, wherein the inflow grooves are formed in a direction facing a sealed chamber formed by the stationary wrap and the orbiting wrap.

11. The scroll compressor of claim 1, wherein a first damping groove is formed on an inner circumferential surface of the receiving portion, and a second damping groove is formed on a front surface of the stopper.

12. The scroll compressor of claim 11, wherein the first damping groove is spaced from a rear wall of the stopper in front of the receiving portion.

13. The scroll compressor of claim 11, wherein the second damping groove has an arc or semicircular cross section, and a center of the arc or semicircular second damping groove does not exceed a height of the first damping groove.

14. The scroll compressor of claim 11, wherein a third damping groove is formed between the stopper and the second damping groove.

15. The scroll compressor of claim 14, wherein the third damping groove has an arc or semicircular cross section, and a center of the arc or semicircular third damping groove does not exceed a height of the receiving portion.

16. The scroll compressor of claim 15, wherein the third damping groove has a cross sectional area smaller than that of the second damping groove.

17. The scroll compressor of claim 16, wherein a line connecting the centers of the cross sections of the stopper, the third damping groove, the second damping groove, and the first damping groove has a stepped shape.

18. The scroll compressor of claim 14, wherein the second damping groove and the third damping groove have a circular or arc shape.

19. The scroll compressor of claim 14, wherein a round shape is formed between the second damping groove and the third damping groove.

20. The scroll compressor of claim 11, wherein first and second stepped portions are formed on both sides of the receiving portion, and the first and second stepped portions have an inner diameter greater than that of the inner circumferential surface of the receiving portion.

21. The scroll compressor of claim 20, wherein the first stepped portion is formed on both sides of the first damping groove.

22. The scroll compressor of claim 1, wherein the bearing tube is made of cast iron, and the housing is made of aluminum, the housing being integrally formed with the bearing tube by aluminum die casting.

23. The scroll compressor of claim 22, wherein an axial locking projection is formed on an outer circumferential surface of the bearing tube.

24. The scroll compressor of claim 23, wherein a first rotation preventing groove is formed in the axial locking projection.

25. The scroll compressor of claim 1, wherein a second rotation preventing groove is formed in the bearing tube.

* * * * *